US008486600B2

(12) United States Patent
Fukushima et al.

(10) Patent No.: US 8,486,600 B2
(45) Date of Patent: Jul. 16, 2013

(54) CARRIER FOR DEVELOPING ELECTROSTATIC CHARGE IMAGE, DEVELOPER FOR ELECTROSTATIC CHARGE IMAGE, PROCESS CARTRIDGE AND IMAGE FORMING APPARATUS

(75) Inventors: Norihito Fukushima, Kanagawa (JP); Akihiro Iizuka, Kanagawa (JP); Yosuke Tsurumi, Kanagawa (JP); Takahiro Yamashita, Kanagawa (JP); Shintaro Anno, Kanagawa (JP); Yasuaki Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 240 days.

(21) Appl. No.: 13/034,390

(22) Filed: Feb. 24, 2011

(65) Prior Publication Data

US 2011/0236814 A1 Sep. 29, 2011

(30) Foreign Application Priority Data

Mar. 25, 2010 (JP) ..... 2010-070972
Sep. 1, 2010 (JP) ..... 2010-196161

(51) Int. Cl.
*G03G 9/107* (2006.01)
*G03G 9/113* (2006.01)

(52) U.S. Cl.
USPC ..... 430/111.32; 430/111.35

(58) Field of Classification Search
USPC ..... 430/111.35, 111.32, 111.1; 399/252
See application file for complete search history.

(56) References Cited

U.S. PATENT DOCUMENTS

| | | | | |
|---|---|---|---|---|
| 5,631,116 | A * | 5/1997 | Uchida et al. | 430/111.1 |
| 6,235,443 | B1 | 5/2001 | Kayamoto et al. | |
| 8,318,399 | B2 * | 11/2012 | Hasegawa et al. | 430/111.35 |
| 2009/0010674 | A1 * | 1/2009 | Inoue et al. | 399/100 |
| 2010/0068645 | A1 * | 3/2010 | Iwatsuki et al. | 430/111.3 |

FOREIGN PATENT DOCUMENTS

| | | |
|---|---|---|
| JP | A-2000-242044 | 9/2000 |
| JP | A-2006-79022 | 3/2006 |
| JP | A-2009-9000 | 1/2009 |
| JP | A-2009-186769 | 8/2009 |

OTHER PUBLICATIONS

Diamond, A.S., et al., ed., Handbook of Imaging Materials, Second Edition, Marcel Dekker, Inc., NY (2002), pp. 146-148.*
Grant, R., et al., ed., Grant & Hackh's Chemical Dictionary,Fifth edition, McGraw Hill Book Company, NY (1987), pp. 232 and 349.*

* cited by examiner

*Primary Examiner* — Janis L Dote
(74) *Attorney, Agent, or Firm* — Oliff & Berridge, PLC

(57) ABSTRACT

A carrier for developing an electrostatic charge image, including a core, and a coating layer including a resin and inorganic oxide particles that exhibit electroconductivity, by which the core is coated, wherein the inorganic oxide particles have, when they are aggregated, an aggregation size of, or when they are not aggregated, a primary particle size of, from 230 nm to 970 nm.

16 Claims, 4 Drawing Sheets

CARRIER FOR DEVELOPING ELECTROSTATIC CHARGE IMAGE, DEVELOPER FOR ELECTROSTATIC CHARGE IMAGE, PROCESS CARTRIDGE AND IMAGE FORMING APPARATUS

CROSS-REFERENCE TO RELATED APPLICATIONS

This application is based on and claims priority under 35 USC 119 from Japanese Patent Applications Nos. 2010-070972 filed Mar. 25, 2010 and 2010-196161 filed Sep. 1, 2010.

BACKGROUND

1. Technical Field

The present invention relates to a carrier for developing an electrostatic charge image, a developer for an electrostatic charge image, a process cartridge and an image forming apparatus.

2. Related Art

Recently, a process including adding an electroconductive agent other than carbon black has been considered aiming at improving dullness of images in carriers for electrophotography.

SUMMARY

According to an aspect of the invention, there is provided a carrier for developing an electrostatic charge image, including:

a core; and a coating layer including a resin and inorganic oxide particles that show electroconductivity, by which the core is coated, wherein the inorganic oxide particles have, when they are aggregated, an aggregation size of, or when they are not aggregated, a primary particle size of, from 230 nm to 970 nm.

BRIEF DESCRIPTION OF THE DRAWINGS

Exemplary embodiments of the present invention will be described in detail based on the following figures, wherein.

DETAILED DESCRIPTION

Figure 1:
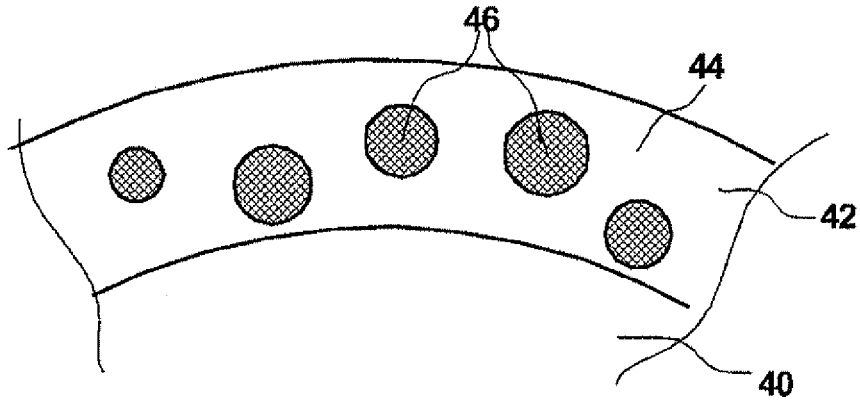
FIG. 1 is a schematic constitutional drawing that shows a part of the carrier of a first aspect of the present exemplary embodiment.

Hereinafter, the present invention is explained in more detail with referring to the exemplary embodiments.

<Carrier for Developing Electrostatic Charge Image>

The carrier for developing an electrostatic charge image (hereinafter sometimes referred to as "carrier") of the present exemplary embodiment includes a core and a coating layer by which the core is coated, and the coating layer includes a resin and inorganic oxide particles that show electroconductivity (hereinafter sometimes referred to as "inorganic oxide particles"). The inorganic oxide particles have, when they are aggregated, an aggregation size of, or when they are not aggregated, a primary particle size of, from 230 nm to 970 mm Decrease in carrier resistance is controlled as compared to the case when the coating layer does not include inorganic oxide particles that show electroconductivity having a primary particle size or aggregation size of from 230 nm to 970 nm.

In the carrier of the present exemplary embodiment, inorganic oxide particles are used as the electroconductive particles. By using the inorganic oxide, dullness of an image is improved as compared to the case when carbon black is used.

Furthermore, as a measure for controlling decrease in carrier resistance and thus decrease in properties for charging a toner when inorganic oxide particles are used, the present inventors have focused on formation of conduits by the inorganic oxide particles in the coating layer, and achieved the carrier of the present exemplary embodiment. Specifically, in order to impart extensiveness as a space in the coating layer to the inorganic oxide particles, the primary particle size or aggregation size of the inorganic oxide particles is adjusted to from 230 nm to 970 nm as mentioned above. When the primary particle size or aggregation size is lower than 230 nm, electroconductivity is decreased. Therefore, the addition amount of the inorganic oxide particles serving as electroconductive materials needs to be increased. As a result, secondary adverse effects such in that charge exchanging property is decreased, environmental dependency is increased, and development stress is increased, are caused. On the other hand, when the primary particle size or aggregation size is more than 970 nm, the inorganic oxide particles are easily exposed on the surface of the coating layer, inorganic oxide particles having a high specific gravity are readily detached by receiving development stress, whereby variations such as increase in carrier resistance are caused, and thus, dullness of an image is caused and fine line reproducibility is decreased. On the other hand, when the primary particle size or aggregation size of the inorganic oxide particles is adjusted to from 230 nm to 970 nm, environmental dependency is decreased, whereby carrier resistance is within a certain desired range even after receiving development stress.

First, the main constitution and materials of the carrier of the present exemplary embodiment are explained below.

(Core)

The core material used in the present exemplary embodiment is not specifically limited, and examples include cores that are composed of magnetic metals such as iron, steel, nickel and cobalt, and magnetic particle-dispersion type cores including a magnetic oxide such as ferrite and magnetite, magnetic particles and a binder resin.

Preferable examples of the above ferrite include those having the structure represented by the following Formula (1).

$$(MO)_X(Fe_2O_3)_Y \quad (1)$$

In the Formula (1), M represents at least one selected from the group consisting of Cu, Zn, Fe, Mg, Mn, Ca, Li, Ti, Ni, Sn, Sr, Al, Ba, Co and Mo. X and Y represent a mol ratio and satisfy the condition of X+Y=100.

In the present exemplary embodiment, the magnetic particle dispersion-type core is constituted by dispersing the magnetic particles in the binder resin.

As the above magnetic particles, any of conventionally-known ones may be used. Specifically, it is desirable to select ferrite, magnetite or maghematite. Specifically, as magnetic particles having strong magnetic property, magnetite or maghematite is selected, and as other magnetic particles, for example, iron powder is known. Since iron powder has a high specific gravity and readily deteriorates a toner, ferrite, magnetite and maghematite are more excellent in stability.

Specific examples of the magnetic particles include iron-based oxides such as magnetite, γ-iron oxide, Mn—Zn-based ferrite, Ni—Zn-based ferrite, Mn—Mg-based ferrite, Li-based ferrite and Cu—Zn-based ferrite. Among these, it is more desirable to use magnetite since it is inexpensive.

The particle size of the magnetic particles is desirably from 0.01 μm to 1 μm, more desirably from 0.05 μm to 0.7 μm, and further desirably from 0.1 μm to 0.6 μm. When the particle size of the magnetic particles is within the range of from 0.01 μm to 1 μm, decrease in magnetic force is controlled and a uniform core is obtained readily.

The content of the magnetic particles in the core is preferably from 30% by mass to 95% by mass, more preferably from 45% by mass to 90% by mass, and further preferably from 60% by mass to 90% by mass. When the content of the magnetic particles is within the above range, decrease in magnetic force per one carrier is controlled and sufficient binding force may be obtained, whereby scattering and the like are controlled. Furthermore, excess hardening of a magnetic brush is controlled and cracking of the magnetic brush is controlled, whereby loading on a toner is controlled and roughness of an image is controlled.

Examples of the binder resin that constitutes the magnetic particle dispersion-type core in the present exemplary embodiment include crosslinked styrenic resins, acrylic-based resins, styrenic-acrylic-based copolymer resins, and phenolic resins, and phenolic resins are specifically preferable.

Furthermore, in the present exemplary embodiment, the magnetic particle dispersion-type core may further include other components according to the purpose.

Examples of the other components include a charge controlling agent, and fluorine-containing particles.

(Coating Layer)

The carrier in the present exemplary embodiment includes a coating layer by which the above core is coated.

The coating layer includes a resin together with inorganic oxide particles that show electroconductivity. In the coating layer, the inorganic oxide particles have, when they are aggregated, an aggregation size of, or when they are not aggregated, a primary particle size of, from 230 nm to 970 nm.

—Resin—

As the resin used for the coating layer, any known matrix resin may be used as long as it is used as a material for a coating layer for a carrier, and two or more resins may be used in combination. The matrix resins for constituting the coating layer are roughly classified into charge-imparting resins for imparting charging property to a toner and resins having low surface energy that are used for preventing transfer of toner components to a carrier.

Examples of the charge-imparting resins for imparting negative charging property to a toner include amino-based resins such as urea-formaldehyde resins, melamine resins, benzoguanamine resins, urea resins and polyamide resins and epoxy resins, as well as polyvinyl and polyvinylidene-based resins, acrylic resins, polymethyl methacrylate resins, polycyclohexyl methacrylate resins, polystyrene-based resins such as styrene-acrylic copolymer resins, polyacrylonitrile resins, polyvinyl acetate resins, polyvinyl acetate resins, polyvinyl alcohol resins, polyvinyl butyral resins, and cellulose-based resins such as ethylcellulose resins.

Examples of the charge-imparting resins for imparting positive charging property to a toner include polystyrene resins, halogenated olefin resins such as polyvinyl chloride, polyester-based resins such as polyethylene telephthalate resins and polybutylene telephthalate resins, and polycarbonate-based resins.

Examples of the resins having low surface energy that are used for preventing transfer of toner components to a carrier include polyethylene resins, polyvinyl fluoride resins, polyvinylidene fluoride resins, polytrifluoroethylene resins, polyhexafluoropropylene resins, copolymers of vinylidene fluoride and an acrylic monomer, copolymers of vinylidene fluoride and vinyl fluoride, fluoroterpolymers such as terpolymers of tetrafluoroethylene, vinylidene fluoride and a non-fluoride monomer, and silicone resins.

Specifically, a polymer including repeating units derived from a methacrylic acid ester having an alicyclic group is preferable as the resin for the coating layer. Since this polymer is highly hydrophobic, a carrier having a resin layer including this polymer shows stable resistance and charging property.

The polymer including repeating units derived from a methacrylic acid ester having an alicyclic group is a polymer obtained by using a methacrylic acid ester having an alicyclic group as a monomer. Specific examples of the methacrylic acid ester having an alicyclic group include cyclohexyl methacrylate, cyclodecyl methacrylate, adamantyl methacrylate, cyclopropyl methacrylate, cyclobutyl methacrylate, cyclopentyl methacrylate, cycloheptyl methacrylate, cyclooctyl methacrylate, cyclononyl methacrylate, isobornyl methacrylate, cyclonorbornyl methacrylate, and cyclobornyl methacrylate. Among these, cyclohexyl methacrylate, cyclodecyl methacrylate and the like are desirable, and cyclohexyl methacrylate is further desirable. The alicyclic group is desirably a cyclohexyl group in view of the hydrophobicity of the polymer and the strength of the resin layer.

The polymer including repeating units derived from a methacrylic acid ester having an alicyclic group may also be a copolymer that further includes repeating units derived from a methacrylic acid ester having a chain group. In the present exemplary embodiment, the "chain group" means a group that has a chain structure in which atoms that constitute a main chain are arrayed linearly and does not include an alicyclic structure in the main chain. The "chain group" may have a branched structure. Specific examples of the methacrylic acid ester having a chain group include methyl methacrylate, ethyl methacrylate, n-butyl methacrylate, isobutyl methacrylate, and tert-butyl methacrylate, of which methyl methacrylate is desirable.

Generally, a resin layer including a resin (polymer) having enhanced hydrophobicity sometimes has poor adhesion with a core, or becomes brittle. The above failings are overcome by using a copolymer including repeating units derived from a methacrylic acid ester having a chain group as a coating resin.

When the polymer including repeating units derived from a methacrylic acid ester having an alicyclic group is a copolymer, the mass ratio of the repeating units derived from a methacrylic acid ester having an alicyclic group to the repeating units derived from a methacrylic acid ester having a chain group may be from 99:1 to 80:20, or may be from 95:5 to 85:15. When the mass ratio of the repeating units derived from a methacrylic acid ester having an alicyclic group to the repeating units derived from a methacrylic acid ester having a chain group is in the range of from 99:1 to 80:20, the adhesion of the resin layer to the core is improved.

The weight average molecular weight of the polymer including repeating units derived from a methacrylic acid ester having an alicyclic group is desirably from $4.0\times10^4$ to $3.0\times10^5$, and more desirably from $5.0\times10^4$ to $2.0\times10^5$. When the weight average molecular weight of the polymer including repeating units derived from a methacrylic acid ester having an alicyclic group is in the range of from $4.0\times10^4$ to $3.0\times10^5$, the dispersing property of a dispersing material such as a resistance controlling agent included in the resin layer is improved. As a result, reproducibility of an image density under a high temperature and a high humidity is further improved.

The above weight average molecular weight is measured by gel permeation chromatography (GPC). The molecular weight measurement by GPC is performed by using a measurement apparatus (trade name: GPC HLC-8120, manufactured by Tosoh Corporation) and using a column (trade name: TSK GEL SUPER HM-M (15 cm), manufactured by Tosoh Corporation) in a THF solvent. The weight average molecular weight is measured using a molecular weight calibration curve that is prepared from the measurement results by using a monodispersed polystyrene standard sample.

When a polycyclohexyl methacrylate resin is used, excellent charging property is obtained as mentioned above, and variation according to an environment is controlled. However, in general, mechanical strength is insufficient, and adhesion to the core tends to decrease. As a result, a flake-like product generated by peeling of the coating layer due to development stress comes to be mixed in an image section and causes color dullness of the image, whereby chromaticness and brightness tend to be deteriorated. Furthermore, carrier resistance tends to decrease due to peeling of the coating layer.

However, the carrier of the present exemplary embodiment does not use carbon black that causes dullness of an image. Furthermore, decrease in carrier resistance may also be controlled by adjusting the primary particle size or aggregation size of the inorganic oxide particles as mentioned below.

—Inorganic Oxide Particles—

Inorganic oxide particles are added to the coating layer of the present exemplary embodiment aiming at adjusting resistance. The inorganic oxide particles have, when they are aggregated, an aggregation size of, or when they are not aggregated, a primary particle size of, from 230 nm to 970 nm. Meanwhile, the present exemplary embodiment may have two or more coating layers, and in such case, the inorganic oxide particles are desirably included in the outermost layer.

As the inorganic oxide particles, those being white or colorless are desirable, and examples include tin oxide, zinc oxide, magnesium oxide, magnesium hydroxide, and composite oxides of magnesium, calcium and aluminum and a metal such as silicon. Among these, magnesium oxide, magnesium hydroxide, zinc oxide and tin oxide are desirable since they have high ability of imparting charge to a toner, and tin oxide is more desirable in view of stability of ability of imparting charge.

Since these inorganic oxide particles are white, dullness of an image is controlled as compared to carbon black. The inorganic oxide particles may be used either singly or in combination of two or more thereof.

The inorganic oxide particles may also be doped. Examples of the doped inorganic oxide particles include antimony-doped tin oxide, tin-doped indium oxide, and aluminum-doped zinc oxide.

The doped inorganic oxide particles are prepared by applying a known process. Examples include solid-phase processes such as pulverization, vapor-phase processes such as a flame process, a plasma process, a vacuum deposition process and a sputtering process, and liquid-phase processes such as a coprecipitation process, a homogeneous precipitation process, a metal alkoxy process and a spray drying process. Among these, a dry solid-phase process is desirable for the controllability of a particle size and decreased incorporation of impurities.

The inorganic oxide particles have, when they are aggregated, an aggregation size of, or when they are not aggregated, a primary particle size of, from 230 nm to 970 nm, desirably from 300 nm to 800 nm, and more desirably from 350 nm to 600 nm. When the aggregation size or primary particle size is within the above range, generation of secondary adverse effects such that environmental dependency of the charging amount is increased and development stress is increased, are controlled, whereby decrease in carrier resistance due to the development stress is controlled.

The primary particle size or aggregation size of the above inorganic oxide particles is a value that is obtained by observing the cross-sectional surface of the carrier to which the inorganic oxide particles have been applied by using a scanning electron microscope (SEM), measuring 50 inorganic oxide particles and obtaining the average value thereof.

Furthermore, in the coating layer, the inorganic oxide particles have, when they are aggregated, a particle size distribution (GSD) of the aggregation size of, or when the particles are not aggregated, a particle size distribution (GSD) of the primary particle size of, preferably 2.0 or more, more preferably 2.1 or more, further preferably from 2.3 to 5.0, and further more preferably from 2.5 to 4.0. When the particle size distribution (GSD) is within the above range, the inorganic oxide particles have extensiveness as a space due to formation of conduits in the coating layer, whereby decrease in resistance is controlled even if a smaller addition amount is used, and excellent resistance controlling property is exhibited. Furthermore, when the addition amount of the inorganic oxide particles is decreased, peeling from the coating layer is controlled, and dullness of an image, and the like caused by the peeled product are controlled.

The above particle size distribution (GSD) is obtained by observing the cross-section of the carrier to which the inorganic oxide particles have been applied by a scanning electron microscope (SEM), measuring the primary particle size or aggregation size for 100 inorganic oxide particles, and using the following formula:

$$\text{Particle size distribution } (GSD)=GSD=(D_{84p}/D_{16p})^{0.5}$$

wherein $D_{16p}$ is a particle size at which a cumulation number becomes 16% and $D_{84p}$ is a particle size at which a cumulation becomes 84%, when a number cumulative distribution is drawn from smaller sizes for the particle size of the particles.

Next, preferable aspects of the coating layer that is constituted by including the inorganic oxide particles is explained.

A first aspect is a case when the inorganic oxide particles are not aggregated particles and have a primary particle size of from 230 nm to 970 nm. FIG. 1 is a schematic constitutional drawing that shows a part of the carrier including the inorganic oxide particles of the first aspect.

The carrier shown in FIG. 1 has a core 40 and a coating layer 42 by which the surface of the core 40 is coated, and the coating layer 42 includes a resin 44 and inorganic oxide particles 46 of the first aspect. The inorganic oxide particles 46 of the first aspect are not aggregated, and the primary particle size thereof is from 230 nm to 970 nm.

As shown in FIG. 1, when the primary particle size of the inorganic oxide particles 46 of the first aspect is from 230 nm to 970 nm, the inorganic oxide particles 46 are not exposed from a surface of the coating layer. Therefore, detachment of the inorganic oxide particles 46 is controlled even after receiving development stress, whereby decrease in charging property is controlled. Furthermore, conduits are formed by the inorganic oxide particles 46, whereby decrease in charging property is controlled.

Figure 2:
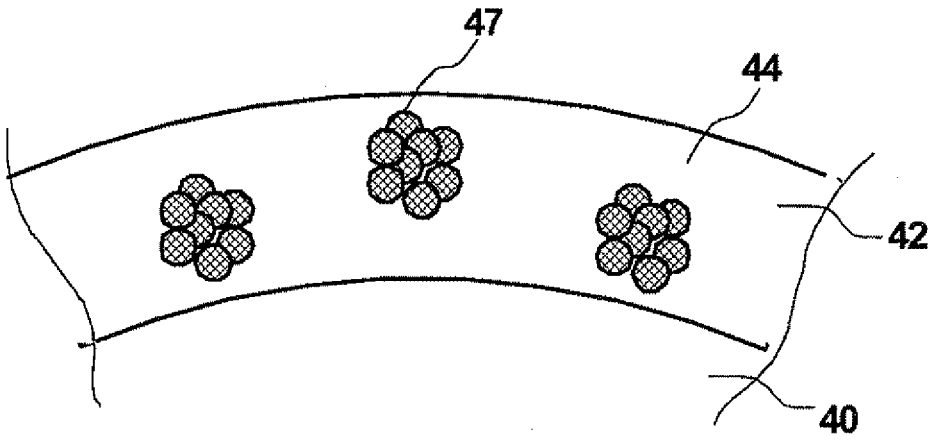
FIG. 2 is a schematic constitutional drawing that shows a part of the carrier of a second aspect of the present exemplary embodiment.

A second aspect is a case when the inorganic oxide particles are aggregated particles and have an aggregation size of from 230 nm to 970 nm. FIG. 2 is a schematic constitutional drawing that shows a part of the carrier including the inorganic oxide particles of the second aspect.

The carrier shown in FIG. 2 has a core 40 and a coating layer 42 by which the surface of the core 40 is coated, and the coating layer 42 includes a resin 44 and inorganic oxide particles 47. The inorganic oxide particles 47 of the second aspect are aggregated and have an aggregation size of from 230 nm to 970 nm.

In the inorganic oxide particles 47 of the second aspect, the ratio of the aggregation size to the primary particle size regarding the inorganic oxide particles 47 is desirably from 2.8 to 7.5. When the ratio is within this range, decrease in electroconductivity is controlled. Therefore, it is not necessary to increase an addition amount, and generation of the above secondary adverse effects is controlled. Furthermore, charging property is readily made uniform, and the behavior of charging of the toner may be stabilized. Moreover, when the ratio is within the above range, significant increase in the specific surface area is controlled, exposure of the inorganic oxide particles 47 from the surface of the coating layer is controlled, and environmental dependency is also controlled.

Furthermore, when the ratio of the aggregation size to the primary particle size is from 2.8 to 3.9, and further from 2.8 to 3.5 in the second aspect, electroconductive conduits are formed by the size of the electroconductive powder, which is preferable in view of controllability of electric resistance.

Moreover, in the second aspect, when the ratio of the aggregation size to the primary particle size is from 4.0 to 7.0, and further from 5.0 to 6.2, dispersion of the electroconductive powder is improved in the coating film to suppress exposure. This is preferable in that the effect of the electric resistance of the carrier on environments is controlled.

The ratio of the aggregation size to the primary particle size of the second inorganic oxide particles 47 is obtained by observing the cross-sectional surface of the carrier to which the inorganic oxide particles have been applied by using a scanning electron microscope (SEM), measuring the primary particle size and aggregation size and obtaining the ratio thereof for 50 aggregated inorganic oxide particles 47, and calculating the average value thereof.

The content of the inorganic oxide particles in the coating layer is desirably from 0.2% by mass to 10% by mass, and more desirably from 0.4% by mass to 5.0% by mass with respect to the carrier from the viewpoints of retention of the strength of the coating layer and adjustment of the resistance of the carrier.

—Other Additives—

It is essential for the present exemplary embodiment to use the above specific inorganic oxide particles as the electroconductive material, and a general electroconductive material may be used in combination. Examples include metals such as gold, silver and copper, barium sulfate, aluminum borate, potassium titanate, resin particles coated with a metal, and carbon black. However, in the present exemplary embodiment, it is desirable to select a white or transparent electroconductive material or an electroconductive material having a low colorability in view of controlling color stain and deterioration of color reproducibility as much as possible. When an electroconductive material having high colorability such as carbon black is used, it is desirable to add the material to the extent that color stain and color reproducibility are not significantly affected. In the case when carbon black is used in combination, it is desirable to use carbon black by 0.6% by mass or less with respect to the carrier.

Furthermore, the coating layer may include resin particles for the purpose of controlling charging. As a resin that constitutes the resin particles, thermoplastic resins and thermosetting resins are utilized.

Examples of the thermoplastic resin include polyolefin-based resins such as polyethylene and polypropylene; polyvinyl and polyvinylidene-based resins such as polystyrene, acrylic resins, polyacrylonitrile, polyvinyl acetate, polyvinyl alcohol, polyvinyl butyral, polyvinyl chloride, polyvinyl carbazole, polyvinyl ether and polyvinyl ketone; vinyl chloride-vinyl acetate copolymers; styrene-acrylic acid copolymers; straight silicone resins including organosiloxane bonds or modified products thereof; fluorine resins such as polytetrafluoroethylene, polyvinyl fluoride, polyvinylidene fluoride and polychlorotrifluoroethylene; polyesters; and polycarbonates.

Examples of the thermosetting resin include phenolic resins; amino resins such as urea-formaldehyde resins, melamine resins, benzoguanamine resins, urea resins and polyamide resins; and epoxy resins.

The volume average particle size of the resin particles is preferably from 0.1 μm to 1.5 μm. When the particle size is within the above range, aggregation in the coating layer is controlled and charging property is maintained stably. Furthermore, cracking of the coating layer is controlled. Moreover, detachment of the resin particles from the coating layer is controlled, whereby function to impart charge is exhibited.

—Physical Properties of Carrier—

The thickness of the coating layer in the carrier of the present exemplary embodiment is desirably from 0.3 μm to 10 μm, and more desirably from 0.5 μm to 5 μm.

Furthermore, the thickness of the above coating layer is desirably from 0.8 to 10 times, and more desirably from 1.0 to 3.0 times with respect to the primary particle size of the inorganic oxide particles when they are not aggregated or the aggregation size when they are aggregated. When the thickness is within the above range, decrease in charging property is controlled, and detachment of the inorganic oxide particles from the surface of the coating layer is controlled.

The thickness of the above coating layer is obtained by measuring the thickness of the resin layer at 4 portions for 4 visual fields on the cross-sectional surface of a carrier by using a scanning electron microscope at a magnification of 100,000 times and taking the average value thereof as the film thickness of the carrier; and measuring the film thicknesses of 40 carrier particles and obtaining the average value thereof.

The carrier of the present exemplary embodiment has a magnetic force at 1 kOe of desirably from 170 emu/cm$^3$ to 250 emu/cm$^3$, and more preferably from 185 emu/cm$^3$ to 235 emu/cm$^3$.

When the magnetic force of the carrier is within the above range, the magnetic binding force against a developer holder is in a suitable range, whereby scattering of the toner and carrier from the developer holder is controlled and generation of image quality defects such as white spots on an image is controlled.

The magnetic force of the carrier is a value obtained by taking a predetermined amount of a sample, putting the sample into a VSM room temperature sample case for powders (H-2902-151), weighing the sample precisely, and measuring the magnetic force in a magnetic field at 1 kOe using a vibrating sample magnetometer (trade name: BHV-525, manufactured by Riken Denshi Co., Ltd.).

Furthermore, the carrier of present exemplary embodiment has a sphericity in the range of desirably from 0.980 to 1.000, and more preferably from 0.985 to 1.000.

When the sphericity of the carrier is within the above range, the flowability of the carrier is improved, and a magnetic brush is uniformized.

As used herein, the above sphericity of the carrier means an average degree of circularity that is measured by the following process.

200 mg of a carrier as a measurement sample is added to 30 ml of an aqueous ethylene glycol solution and stirred, and the supernatant of the aqueous solution is removed. The carrier in the residue is measured by the following process. The measurement is performed by using FPIA-3000 (trade name, manufactured by Sysmex Corporation). Image analysis is performed on each of at least 5000 or more of the carrier particles that have been photographed, and a static processing is performed to give an average circularity. Meanwhile, each circularity is obtained based on the following Formula (2).

$$\text{Circularity}=\text{equivalent circle diameter circumference length/circumference length}=[2\times(A\times\pi)^{1/2}]/PM \quad \text{Formula (2)}$$

In the above Formula (2), A represents the projection surface area of the carrier particles and PM represents the circumference length of the carrier particles.

The measurement is performed at a HPF mode (high resolution mode) and a dilution magnification of 10 times. Furthermore, in the data analysis, a number particle size analysis is performed in the range of from 3 μm to 80 μm and a circularity analysis is performed in the range of from 0.850 to 1.000 for the purpose of removing measurement noise.

Furthermore, the volume average particle size of the carrier in the present exemplary embodiment is desirably in the range of from 25 μm to 100 μm, more desirably in the range of from 25 μm to 80 μm, and further desirably in the range of from 25 μm to 60 μm.

When the volume average particle size of the carrier is in the above range, a magnetic binding force to the developer holder becomes sufficient, whereby adhesion of the carrier on a photoreceptor is controlled. Furthermore, distortion of the particle shape is controlled, and excellent fine line reproducibility is exhibited.

As used herein, the volume average particle size of the carrier refers to a value that is measured by using a laser diffraction/scatter-type particle size distribution measurement apparatus (trade name: LS PARTICLE SIZE ANALYZER: LS13 320, manufactured by BECKMAN COULTER). A volume cumulative distribution is subtracted starting from the smaller particle sizes side with respect to the particle size range (channel) obtained by dividing the obtained particle size distribution, and the particle size at which a cumulation becomes 50% with respect to the whole particles is considered to be a volume average particle size $D_{50v}$.

Furthermore, the volume resistivity of the carrier of the present exemplary embodiment is controlled to be desirably in the range of from $1\times10^{7}$ Ωcm to $1\times10^{14}$ Ωcm, more desirably in the range of from $1\times10^{8}$ Ωcm to $1\times10^{13}$ Ωcm, and further desirably in the range of from $1\times10^{8}$ Ωcm to $1\times10^{12}$ Ωcm.

When the volume resistivity of the carrier is within the above range, decrease in solid image reproducibility is controlled. Furthermore, injection of electron charge from a developing roll to the carrier is controlled even the toner concentration in the developer is decreased, whereby a deficiency that the carrier itself is developed is controlled.

The above volume resistivity (Ωcm) of the carrier is measured as follows. The measurement environment is at a temperature of 20° C. under a humidity of 50% RH.

The carrier to be measured is evenly put on the surface of a circular fixture on which an electrode plate of 20 $cm^2$ is disposed so that the carrier has a thickness of about from 1 to 3 mm to form a carrier layer. An electrode plate of 20 $cm^2$ same as above is put on the carrier layer to tuck the carrier layer between the electrode plates. In order to eliminate the voids in the carrier, a load of 4 kg is applied to the electrode plate disposed on the carrier layer before the measuring the thickness (cm) of the carrier layer. The both electrodes above and below the carrier layer are connected to an electrometer and a high voltage electric source generating apparatus. A high voltage is applied to the both electrodes so as to have an electrical field of 6000 V/cm, and the value of the electric current (A) that flows at this time is read out, whereby the volume electric resistance (Ω·cm) of the carrier is calculated. The calculation formula of the volume resistivity (Ω·cm) of the carrier is as shown in the following Formula (3).

$$R=E\times20/(I-I_0)/L \quad \text{Formula (3)}$$

In the above Formula (3), R represents the volume resistivity (Ω·cm) of the carrier, E represents an applied voltage (V), I represents a value of an electrical current (A), $I_0$ represents the value of the electrical current (A) when the applied voltage is 0 V, and L represents the thickness (cm) of the carrier layer, respectively. Furthermore, the coefficient 20 represents the surface area ($cm^2$) of the electrode plate.

—Method for Producing Carrier—

Formation of the coating layer for the above carrier is explained.

In a wet coating process, a solution for forming a coating layer that includes a solvent, a resin for forming the coating layer, inorganic oxide particles, if necessary, and resin particles for controlling charge and the like, is used. Examples of the process include a soaking process in which a core is soaked in the solution for forming a coating layer; a spray process in which the solution for forming a coating layer is sprayed on the surface of the core; a fluidized bed process in which the solution for forming a coating layer is sprayed while the core is floated by fluidized air; and a kneader coater process in which the core and the solution for forming a coating layer are mixed in a kneader coater and the solvent is then removed.

The solvent used for the solution for forming a coating layer is not specifically limited as long as it dissolves a resin. For example, aromatic hydrocarbons such as xylene and toluene, ketones such as acetone and methyl ethyl ketone, ethers such as tetrahydrofuran and dioxane, and halide compounds such as chloroform and carbon tetrachloride are used.

A dry coating process may include a powder coating process in which coating resin particles and core particles are heated or mixed at a high speed to perform coating.

In the case when the inorganic oxide particles are not aggregated particles, the coating layer including the inorganic oxide particles having a primary particle size of from 230 nm to 970 nm is prepared by selecting the particle size of the inorganic oxide particles used as a raw material. Furthermore, by using the inorganic oxide particles having a particle size distribution of 2.0 or more as a raw material, a carrier in which the inorganic oxide particles has a particle size distribution of 2.0 or more in the coating layer is prepared. Moreover, the particle size distribution may also be adjusted to 2.0 or more by using two or more inorganic oxide particles having different particle sizes in combination.

On the other hand, a coating layer including the inorganic oxide particles as aggregated particles having an aggregation size of from 230 nm to 970 nm is formed by mixing and coating under a weaken shear force even if either of the above wet and dry processes for forming a coating layer is used. Furthermore, also in the case when the particle size distribution of the inorganic oxide particles is adjusted to 2.0 or more in the coating layer, a process in which mixing and coating are performed under a weaken shear force is desirable. Moreover, also in the case when the inorganic oxide particles are present as aggregated particles in the coating layer, the particle size distribution may be adjusted to 2.0 or more by using two or more inorganic oxide particles having different particle sizes in combination.

Examples of a process for forming a coating layer by a low shear force include a dry process including pre-mixing resin particles to be incorporated into the coating layer with the inorganic oxide particles by using a planetary mixer and then forming the coating layer by a dry treatment apparatus (trade name: NOBILTA NOB130, manufactured by Hosokawa Micron Group, etc.).

The volume average particle size of the coating resin particles used in the dry process is desirably, for example, 1 μm or less. When the volume average particle size of the coating resin particles is within the above range, the core is readily coated by the resin particles.

In the dry process, the shear force that is applied to the inorganic oxide particles is weaken by performing pre-mixing, and by decreasing the mixing condition of the pre-mixing, the rotation velocity or temperature condition of the dry treatment apparatus.

Specifically, in the dry process, the aggregation size is decreased by strengthen the shear force during the pre-mixing of the material or formation of the coating layer, and the ratio of the aggregation size to the primary particle size is decreased by weakening the shear force during the pre-mixing of the material or film formation by decreasing the rotation velocity or treatment time. Examples of the pre-mixing include a mixing condition at about from 60 rpm to 95 rpm for about from 1 hour to 3 hours.

Examples of the wet process include a process in which a coating layer is formed by setting the rotation velocity of a rotor as low as possible (for example, a set value of a rotation number of the rotor of the lower limit value of about from 0.2 to 0.3 (about from 20 rpm to 30 rpm)) by using a kneader (a kneading apparatus manufactured by Inoue Manufacturing Co., Ltd., etc.).

In the wet process, the shear force applied to the inorganic oxide particles is weaken by weakening the mixing condition by the kneader, or by setting the rotation velocity of the rotor low.

Specifically, in the wet process, the aggregation size is decreased by increasing the shear force during the pre-mixing of the material or film formation, and the ratio of the aggregation size to the primary particle size is decreased by weakening the shear force during the pre-mixing of the material or film formation by decreasing the rotation velocity, treatment time, or the like.

<Developer for Electrostatic Charge Image>

The developer for an electrostatic charge image of the present exemplary embodiment (hereinafter sometimes simply referred to as "developer") includes the carrier and toner of the present exemplary embodiment. The developer of the present exemplary embodiment is prepared by mixing the carrier and toner of the present exemplary embodiment by a suitable incorporation ratio. The content of the carrier ((carrier)/(carrier+toner)×100) is desirably in the range of from 85% by mass to 99% by mass, more desirably in the range of from 87% by mass to 98% by mass, and further more desirably in the range of from 89% by mass to 97% by mass.

The toner used for the developer for an electrostatic charge image of the present exemplary embodiment is explained in detail.

The toner used in the present exemplary embodiment includes at least a binder resin and a colorant, and includes a release agent and other components where necessary. Furthermore, it is desirable to add external additives to the toner used for the present exemplary embodiment for various purposes besides so-called toner particles having the above constitution.

Known binder resins and various colorants may be used as the toner used for the present exemplary embodiment. As the binder resin for the toner used in the present exemplary embodiment, polyester resins, as well as polyolefin resins, copolymers of styrene and acrylic acid or methacrylic acid, polyvinyl chloride, phenolic resins, acrylic resins, methacrylic resins, polyvinyl acetate, silicone resins, modified polyester resins, polyurethanes, polyimide resins, furan resins, epoxy resins, xylene resins, polyvinyl butyral, terpene resins, coumaroneindene resins, petrolatum resins, polyether polyol resins and the like may be used singly or in combination.

As the colorant for the toner used in the present exemplary embodiment, cyan colorants such as C. I. Pigment Blue 1, 2, 3, 4, 5, 6, 7, 10, 11, 12, 13, 14, 15, 15:1, 15:2, 15:3, 15:4, 15:6, 16, 17, 23, 60, 65, 73, 83 and 180; cyan pigments such as C. I. Bat Cyan 1, 3 and 20, iron blue, cobalt blue, alkali blue rake, phthalocyanine blue, non-metal phthalocyanine blue, a partial chloride of phthalocyanine blue, First Sky Blue and Indanthrene Blue BC; and cyan dyes such as C. I. Solvent Cyan 79 and 162; and the like may be used.

As a magenta colorant, for example, magenta pigments such as C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207, 209 and the like, and Pigment Violet 19; magenta dyes such as C. I. Solvent Red 1, 3, 8, 23, 24, 25, 27, 30, 49, 81, 82, 83, 84, 100, 109 and 121, C. I. Disperse Red 9, and C. I. Basic Red 1, 2, 9, 12, 13, 14, 15, 17, 18, 22, 23, 24, 27, 29, 32, 34, 35, 36, 37, 38, 39 and 40; and red iron oxide, cadmium red, red lead, mercury sulfide, cadmium, Permanent Red 4R, Lithol Red, Pyrazolone Red, Watching Red, calcium salt, Rake Red D, Brilliant Carmine 6B, cosine rake, Rhodamine Rake B, alizalin rake, Brilliant Carmine 3B and the like may be used.

As a yellow colorant, yellow pigments such as C. L Pigment yellow 2, 3, 15, 16, 17, 97, 180, 185 and 139 may be used.

In the case of a black toner, for example, carbon black, active carbon, titanium black, magnetic powder, non-magnetic powder including Mn, and the like may be used as a colorant therefor.

Furthermore, it is desirable that the toner used for the present exemplary embodiment includes a charge controlling agent, and nigrosine, a quaternary ammonium salt, an organic metal complex, a chelate complex and the like may be used.

Furthermore, silica, titanium oxide, barium titanate, fluorine particles, acrylic particles and the like may be used in combination as an external additive. As the silica, commercial products such as TG820 (trade name, manufactured by Cabot Corporation) and HVK2150 (trade name, manufactured by Clariant) may also be used.

Furthermore, the toner used in the present exemplary embodiment desirably includes a release agent, and examples of the release agent may include ester wax, polyethylene, polypropylene or a copolymer of polyethylene and polypropylene, polyglycerin wax, microcrystalline wax, paraffin wax, carnauba wax, sazole wax, montanic acid ester wax, deoxidized carnauba wax, palmitic acid, stearic acid, montanic acid, unsaturated fatty acids such as brassidic acid, eleostearic acid and parinaric acid, saturated alcohols such as stearyl alcohol, aralkyl alcohols, behenyl alcohol, carnaubyl alcohol, ceryl alcohol, melissyl alcohol and alcohols including an alkyl group whose chain is longer than that of the alkyl group of the above alcohols; polyhydric alcohols such as sorbitol; fatty acid amides such as linoleic acid amide, oleic acid amide and lauric acid amide; saturated fatty acid bisamides such as methylenebisstearic acid amide, ethylenebiscapric acid amide, ethylenebislauric acid amide and hexamethylenebisstearic acid amide, unsaturated fatty acid amides such as ethylenebisoleic acid amide, hexamethylenebisoleic acid amide, N,N'-dioleyladipic acid amide and N,N'-dioleylsebacic acid amide; aromatic bisamides such as m-xylenebisstearic acid amide and N,N'-distearylisophthalic acid amide; metal salts of fatty acids (generally called as metallic soap) such as calcium stearate, calcium laurate, zinc stearate and magnesium stearate; waxes obtained by graft-copolymerizing a vinyl monomer such as styrene and acrylic acid, and an aliphatic hydrocarbon wax; partially-esterified compounds of a fatty acid such as behenic acid monoglyceride and a polyhydric alcohol; methyl ester compounds containing a hydroxyl group obtained by hydrogenating vegetable fat and oil; and the like.

The process for preparing the toner (toner particles) is not specifically limited in the present exemplary embodiment, and preparation by a wet process is desirable for obtaining high image quality. Examples of the wet process include an emulsion-aggregation process in which a polymerizable monomer of a binder resin is subjected to emulsion polymerization, the binder resin dispersion liquid as formed, a colorant, a release agent, and where necessary, a dispersion liquid of a charge controlling agent and the like, are mixed, aggregated and melt-bonded by heating to give toner particles; a suspension polymerization process in which a polymerizable monomer for obtaining a binder resin, a colorant, a release agent, and where necessary, a solution of a charge controlling agent and the like are suspended in an aqueous solvent, and the suspension is polymerized; and a dissolution-suspension process in which a binder resin, a colorant, a release agent, and where necessary, a solution of a charge controlling agent and the like are suspended in an aqueous solvent and granulated. Alternatively, a production process in which the toner particles obtained by the above process are used as cores, and resin particles are further attached to the cores and subjected to heat-melting to impart a core-shell structure may also be performed. Alternatively, toner particles obtained by a general pulverization-classification process may also be used.

<Process Cartridge, Image Forming Apparatus and Image Forming Process>

The image forming apparatus of the present exemplary embodiment includes a latent image holder; a charging device which charges a surface of the latent image holder; an electrostatic latent image-forming device which forms an electrostatic latent image on the surface of the latent image holder; a developing device which develops the electrostatic latent image using the developer for an electrostatic charge image of the present exemplary embodiment to form a toner image; a transfer device which transfers the toner image onto a recording medium; and a fixing device which fixes the toner image on the recording medium. Where necessary, the image forming apparatus of the present exemplary embodiment may include a cleaner which cleans the surface of the latent image holder.

In the image forming apparatus, for example, the part including the above developing device may have a cartridge structure that is attachable to and detachable from the main body of the image forming apparatus (process cartridge). The process cartridge preferably includes a developing device which houses the developer for an electrostatic charge image of the present exemplary embodiment and develops the electrostatic latent image using the developer to form a toner image, which is attached to and detached from the image forming apparatus.

Furthermore, by the image forming apparatus of the present exemplary embodiment, an image forming process of the present exemplary embodiment that includes charging the surface of a latent image holder, forming an electrostatic charge image on the surface of the latent image holder, developing the electrostatic charge image using the developer for an electrostatic charge image of the present exemplary embodiment to form a toner image, transferring the toner image onto a recording medium, and fixing the toner image on the recording medium, is performed. Furthermore, where necessary, the image forming process of the present exemplary embodiment may include cleaning, neutralizing and the like.

As the above respective processes, known processes are adopted, and examples include the processes described in JP-A Nos. 56-40868, and 49-91231. In addition, the image forming method of the present exemplary embodiment is performed, for example, by using image forming apparatuses such as known copying machines, fax machines and the like.

Hereinafter an example of the image forming apparatus of the present exemplary embodiment is shown, but the invention is not limited by this example.

Figure 3:
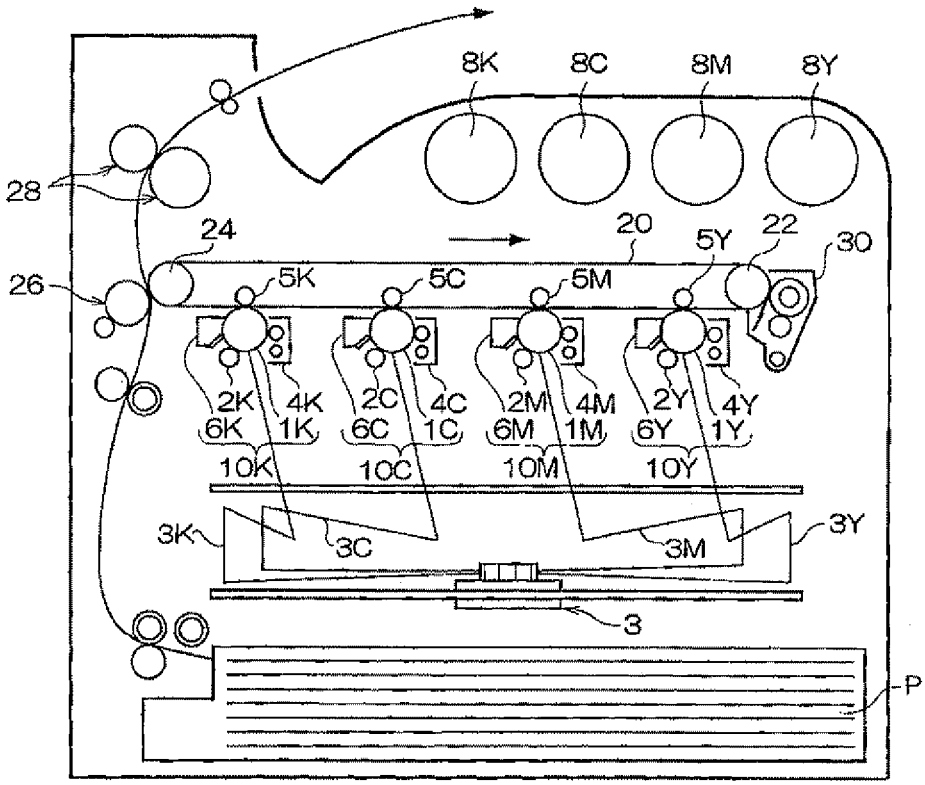
FIG. 3 is a schematic constitutional drawing that shows an example of the image forming apparatus of the present exemplary embodiment.

FIG. 3 is a schematic structural drawing that shows a 4-drum tandem system color image forming apparatus that is the image forming apparatus of the second exemplary embodiment. The image forming apparatus shown in FIG. 3 includes first to fourth electrophotographic image forming units 10Y, 10M, 10C and 10K (image forming means) that output images of respective colors of yellow (Y), magenta (M), cyan (C) and black (K) based on color-separated image data. These image forming units (hereinafter sometimes simply referred to as "units") 10Y, 10M, 10C and 10K are aligned in the horizontal direction at predetermined intervals. These units 10Y, 10M, 10C and 10K may be process cartridges that are attachable to and detachable from the main body of the image forming apparatus.

An intermediate transfer belt 20 as an intermediate transfer body runs through the respective units 10Y, 10M, 10C and 10K above the units in the drawing. The intermediate transfer belt 20 is wrapped around a driving roller 22 and a support roller 24 that is in contact with the inner surface of the intermediate transfer belt 20 which are disposed apart from each other in the direction from the left to the right of the drawing so that the belt runs in the direction from the first unit 10Y to the fourth unit 10K. The support roller 24 is biased toward the direction leaving from the driving roller 22 by a spring and the like that are not depicted, whereby a predetermined tension is applied to the intermediate transfer belt 20 that is wrapped around the rollers. An intermediate transfer body cleaning apparatus 30 is disposed on the side surface of the latent image holder of the intermediate transfer belt 20 so as to oppose to the driving roller 22.

Toners of 4 colors of yellow, magenta, cyan and black that are housed in toner cartridges 8Y, 8M, 8C and 8K are supplied to the respective developing apparatuses (developing device) 4Y, 4M, 4C and 4K of the respective units 10Y, 10M, 10C and 10K.

Since the above first to fourth units 10Y, 10M, 10C and 10K have similar structures, the first unit 10Y for forming a yellow image that is disposed on the upstream of the running direction of the intermediate transfer belt is explained as a representative. The explanations on the second to fourth units 10M, 10C and 10K are omitted by adding the reference symbols of magenta (M), cyan (C) and black (K) instead of yellow (Y) to the units that are similar to the first unit 10Y.

The first unit 10Y has a photoreceptor 1Y that acts as a latent image holder. A charging roller 2Y that charges the surface of the photoreceptor 1Y to a predetermined electrical potential, an exposing apparatus (unit configured to form an electrostatic latent image) 3 that exposes the charged surface to a laser beam 3Y based on color-separated image signal to form an electrostatic latent image, a developing apparatus (unit configured to develop) 4Y that supplies a charged toner to the electrostatic latent image to develop an electrostatic latent image, a primary transfer roller (unit configured to perform primary transfer) 5Y that transfers the developed toner image on the intermediate transfer belt 20, and a photoreceptor cleaning apparatus (unit configured to clean) 6Y that removes the toner remaining on the surface of the photoreceptor 1Y after the primary transfer are disposed in this order around the photoreceptor 1Y.

The primary transfer roller 5Y is disposed on the inside of the intermediate transfer belt 20, and is disposed on the position opposing to the photoreceptor 1Y. Furthermore, bias power sources (not depicted) that apply primary transfer bias are connected respectively to the respective primary transfer rollers 5Y, 5M, 5C and 5K. Each bias power source varies the transfer bias that is applied to each primary transfer roller by the control by a control section that is not depicted.

Hereinafter the operation for forming a yellow image at the first unit 10Y is explained. First, prior to the operation, the surface of the photoreceptor 1Y is charged to have an electrical potential of about from −600 V to −800 V by the charging roller 2Y.

The photoreceptor 1Y is formed by laminating a photosensitive layer on an electroconductive (volume resistance rate at 20° C.: $1\times10^{-6}$ Ωcm or less) substrate. The photosensitive layer has property that it has generally a high resistance (resistance similar to that of a general resin) but when the laser beam 3Y is irradiated, the specific resistance of the part to which the laser beam has been irradiated is changed. Therefore, the laser beam 3Y is output via an exposing apparatus 3 on the surface of the charged photoreceptor 1Y according to image data for yellow that is sent from a control section that is not depicted. The laser beam 3Y is irradiated on the photosensitive layer on the surface of the photoreceptor 1Y, whereby an electrostatic latent image having a yellow printing pattern is formed on the surface of the photoreceptor 1Y.

The electrostatic latent image is an image that is formed on the surface of the photoreceptor 1Y by charging, and is a so-called a negative latent image that is formed by that the specific resistance of the irradiated part of the photosensitive layer is decreased by the laser beam 3Y and the electron charge charged on the surface of the photoreceptor 1Y flows, whereas the electron charge on the part that has not been irradiated with the laser beam 3Y remains.

The electrostatic latent image formed on the photoreceptor 1Y as such is rotated to a predetermined developing position according to the running of the photoreceptor 1Y. Then, the electrostatic latent image on the photoreceptor 1Y is converted to a visible image (developed image) by the developing apparatus 4Y on this developing position.

The developing apparatus 4Y houses, for example, a developer for an electrostatic charge image including at least a yellow toner and a carrier. The yellow toner is friction-charged by being stirred in the developing apparatus 4Y, and retained on a developer roll (developer holder) with an electron charge having similar polarity (negative polarity) to that of the charge that is charged on the photoreceptor 1Y. Furthermore, as the surface of the photoreceptor 1Y passes through the developing apparatus 4Y, the yellow toner electrostatically adheres on the neutralized latent image section on the surface of the photoreceptor 1Y, whereby a latent image is developed by the yellow toner.

In view of developing efficiency, image granularity, gradation reproducibility and the like, a bias electric potential (developing bias) in which a direct current component is overlapped with an alternate current component may be applied to the developer holder. Specifically, when the direct current applied voltage Vdc of the developer holder is from −300 to 700 V, the alternate current voltage peak width Vp-p of the developer holder may be in the range from 0.5 kV to 2.0 kV.

The photoreceptor 1Y on which the yellow toner image has been formed runs continuously at a predetermined velocity, and the toner image developed on the photoreceptor 1Y is carried to a predetermined primary transfer position.

When the yellow toner image on the photoreceptor 1Y is carried to the primary transfer position, a primary transfer bias is applied to the primary transfer roller 5Y, an electrostatic force that goes from the photoreceptor 1Y to the primary transfer roller 5Y acts on the toner image, and the toner image on the photoreceptor 1Y is transferred on the intermediate transfer belt 20. The transfer bias applied at this time has a polarity that is opposite (+) to the polarity of the toner (−), and is controlled to be, for example, about +10 μA by the control section (not depicted) in the first unit 10Y.

On the other hand, the toner remaining on the photoreceptor 1Y is removed by the cleaning apparatus 6Y and collected.

The primary transfer biases that are applied to the primary transfer rollers 5M, 5C and 5K in the second unit 10M and the following units are controlled in accordance with the first unit.

Thus, the intermediate transfer belt 20 on which the yellow toner image has been transferred at the first unit 10Y is carried through the second to fourth units 10M, 10C and 10K in this order, whereby toner images of respective colors are superposed to effect multilayer transfer.

The intermediate transfer belt 20 on which the toner images of four colors have been superposed by multilayer transfer via the first to fourth units goes to the secondary transfer section that is constituted by the intermediate transfer belt 20, the support roller 24 that is in contact with the inner surface of the intermediate transfer belt 20, and a secondary transfer roller (secondary transfer means) 26 that is disposed on the side of the image retention surface of the intermediate transfer belt 20. On the other hand, recording paper (recording medium) P is fed via a feeding mechanism at a predetermined timing to a gap at which the secondary transfer roller 26 and the intermediate transfer belt 20 are brought into contact with pressure, and a secondary transfer bias is applied to the support roller 24. The transfer bias applied at this time has a polarity that is the same (−) as the polarity of the toner (−), and electrostatic force that goes from the intermediate transfer belt 20 toward the recording paper P acts on the toner image, whereby the toner image on the intermediate transfer belt 20 is transferred on the recording paper P. The secondary transfer bias at this time is determined according to the resistance that is detected by a means configured to detect resistance (not depicted) for detecting the resistance at the secondary transfer section, and is controlled by voltage.

The recording paper P is then fed to a pressure-contacting section (nip section) of a pair of fixing rolls of a fixing apparatus (roll-like means for fixing) 28 and the toner image is heated, whereby the color-superposed toner image is melted and fixed on the recording paper P.

Examples of the recording medium on which a toner image is transferred include plain paper, and OHP sheets that are used for electrophotographic copying machines, printers and the like.

The recording paper P on which fixing of a color image has been completed is carried toward an ejection section, whereby a series of operations for forming a color image is completed.

Although the image forming apparatus exemplified above has a structure in which the toner image is transferred on the recording paper P via the intermediate transfer belt 20, the structure is not limited to this, and a structure in which a toner image is directly transferred from a photoreceptor on recording paper may also be available.

Figure 4:
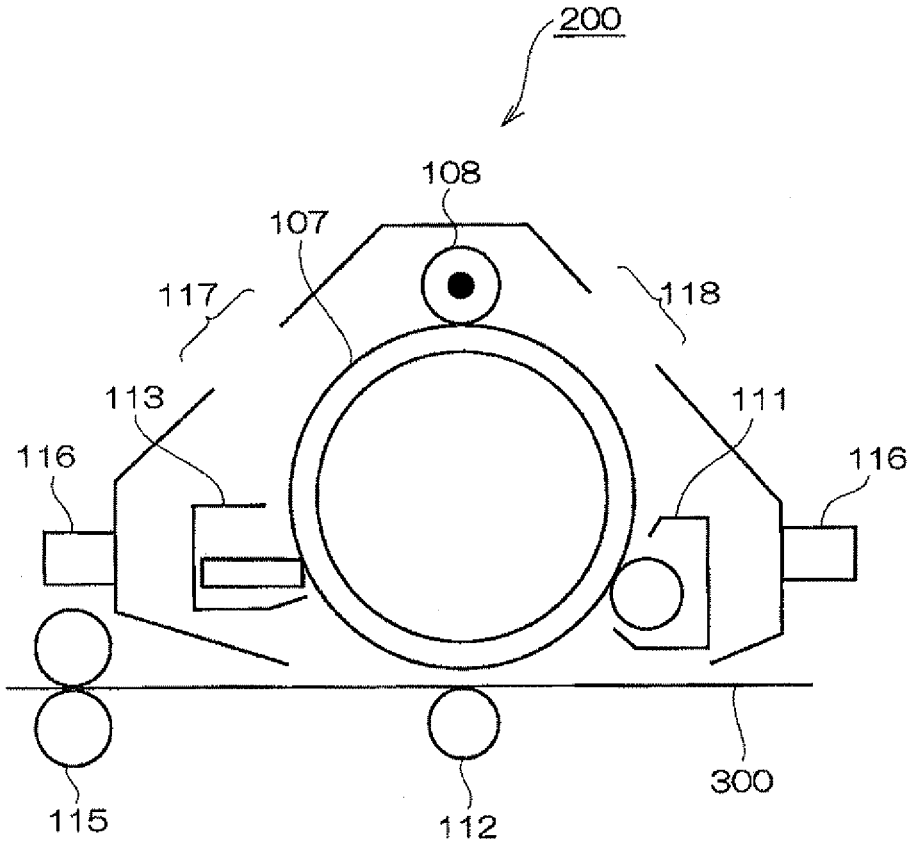
FIG. 4 is a schematic constitutional drawing that shows an example of the process cartridge of the present exemplary embodiment.

FIG. 4 is a schematic structural drawing that shows an example of a process cartridge that houses the developer for an electrostatic charge image of the present exemplary embodiment. Process cartridge 200 is obtained by combining and integrating a developing apparatus 111 together with a photoreceptor 107, a charging roller 108, a photoreceptor cleaning apparatus (unit configured to clean) 113, an opening for exposure 118 and an opening for exposure under neutralization 117 by using an attachment rail 116. Recording medium is represented by 300 in FIG. 4.

The process cartridge 200 is attachable to and detachable from the main body of the image forming apparatus that is constituted by the transfer apparatus 112, the fixing apparatus 115, and other structural parts that are not depicted, and constitutes the image forming apparatus together with the main body of the image forming apparatus.

Although the process cartridge 200 shown in FIG. 4 includes the photoreceptor 107, charging apparatus 108, developing apparatus 111, cleaning apparatus 113, opening for exposure 118, and opening for exposure under neutralization 117, these apparatuses may be selectively combined. The process cartridge of the present exemplary embodiment may include, besides the developing apparatus 111, at least one selected from the group consisting of the photoreceptor 107, charging apparatus 108, cleaning apparatus (means configured to clean) 113, opening for exposure 118 and opening for exposure under neutralization 117.

Next, the toner cartridge is explained. The toner cartridge houses at least a toner to be supplied to the developing device that is disposed on the above image forming apparatus, which is mounted attachably and detachably on the image forming apparatus. The toner cartridge may house at least the toner, and for example, a developer may be housed depending on the mechanism of the image forming apparatus.

The image forming apparatus shown in FIG. 3 is an image forming apparatus that has a structure that enables attaching and detaching of the toner cartridges 8Y, 8M, 8C and 8K, and the developing apparatuses 4Y, 4M, 4C and 4K are connected to toner cartridges that correspond to the respective developing apparatuses (colors) via toner supply tubes that are not depicted. Furthermore, when the toner housed in the toner cartridge is decreased, the toner cartridge is replaced.

EXAMPLES

Hereinafter the present invention is explained specifically with referring to Examples. However, the invention is not limited to only the Examples shown below.

Unless otherwise mentioned, the "part" and "%" in the Examples mean "part by mass" and "% by mass", respectively.

<Processes for Measuring Properties>

First, the processes for measuring the physical properties of the carriers that are used in Examples and Comparative Examples are explained.

(Measurement of Average Particle Size of Particles)

In order to observe the aggregation size and primary particle size of the inorganic oxide particles in the coating layer of the carrier, the carrier is cut by using a microtome, and the cross-sectional surface thereof is observed by using a scanning electron microscope (SEM). In the observed electromicroscopic image, the aggregation size and primary particle size of the inorganic oxide particles are measured. At this time, 50 inorganic oxide particles are observed and the average values thereof are obtained.

(Measurement of Particle Size Distribution of Particles)

The carrier is cut by the same process as that for the measurement of the average particle size as mentioned above, the cross-sectional surface thereof is observed by a scanning electron microscope (SEM), and the aggregation size and primary particle size of the inorganic oxide particles are measured. At this time, 100 inorganic oxide particles are observed; $D_{16p}$, the particle size at which a cumulation becomes 16%, and $D_{84p}$, the particle size at which a cumulation becomes 84%, when a number cumulative distribution is drawn from smaller sizes for the particle size of the particles, are measured; and a particle size distribution (GSD) is obtained according to the following formula:

$$\text{Particle size distribution } (GSD)=(D84p/D16p)^{0.5}$$

(Measurement of thickness of coating layer)

The thickness of the coating layer is measured at 4 portions for 4 visual fields on the cross-sectional surface of a particle of the carrier by using a scanning electron microscope (SEM) at a magnification of 100,000 times. The thicknesses of the coating layers of 40 carrier particles are measured, and the average value thereof is obtained.

(Measurement of Carrier Resistance)

A carrier resistance (Ωcm) is measured as mentioned below. The measurement environment includes a temperature of 20° C. and a humidity of 50% RH.

The carrier to be measured is evenly put on the surface of a circular fixture on which an electrode plate of 20 $cm^2$ is disposed so that the carrier has a thickness of about from 1 to 3 mm to form a carrier layer. An electrode plate of 20 $cm^2$ same as above is put on the carrier layer to tuck the carrier layer between the electrode plates. In order to eliminate the voids in the carrier, a load of 4 kg is applied to the electrode plate disposed on the carrier layer prior to the measurement of the thickness (mm) of the carrier layer. The both electrodes above and below the carrier layer are connected to an electrometer and a high voltage electric source generating apparatus. A high voltage is applied to the both electrodes so as to have an electrical field of $10^{3.8}$ V/cm, and the value of the electric current (A) that flows at this time is read out, whereby the volume electric resistance (Ω·cm) of the carrier is calculated. The calculation formula of the carrier resistivity (Ω·cm) is as shown in the following Formula (3).

$$R=E\times 20/(I-I_0)/L \qquad \text{Formula (3)}$$

In the above Formula (3), R represents the volume resistivity (Ω·cm) of the carrier, E represents an applied voltage (V), I represents a value of an electrical current (A), $I_0$ represents a value of the electrical current (A) when the applied voltage is 0 V, and L represents the thickness (cm) of the carrier layer, respectively. Furthermore, the coefficient 20 represents the surface area ($cm^2$) of the electrode plate. The value of the carrier resistance is written to three significant figures and rounded off to the third digit. The values of electric resistance are shown below, and when the value is, for example, $3.25\times10^8\Omega\cdot cm$, the value is described as 330 on the basis of $\times10^6$.

(Measurement of Variation of Carrier Resistance)

The carrier prepared is stored under a high temperature and a high humidity (a temperature of 27° C. and a humidity of 80% RH) for one day, and carrier resistance is measured by the above measurement process.

Furthermore, the carrier prepared is stored under a low temperature and a low humidity (a temperature of 15° C. and a humidity of 20% RH) for one day, and carrier resistance is measured by the above measurement process.

Example 1A

Preparation of Carrier by Dry Process

- Ferrite particles (Mn—Mg ferrite, true specific gravity: 4.7 $g/cm^3$, volume average particle size: 35 μm, saturation magnetization: 60 emu/g)
- Cyclohexyl methacrylate particles (trade name: XX-406W, manufactured by Sekisui Plastics Co., Ltd., particle size: 200 nm, weight average molecular weight: about 150,000)
- Tin oxide particles (trade name: PASSTRAN 4300, manufactured by Mitsui Mining & Smelting Co., Ltd., volume resistance: 8.9Ω·cm, primary particle size: 100 nm)

The above materials are mixed so that the tin oxide particles are included by 8 vol % in the formed coating layer and a coating layer is formed by 3% by mass with respect to the above ferrite particles, and subjected to pre-mixing by using a planetary mixer under a condition of 60 rpm for 1 hour. A coating layer is then formed on the surface of the ferrite particles by using a dry treatment apparatus (trade name: NOBILTA NOB130, manufactured by Hosokawa Micron Group) by 2,000 rpm at about 50° C. to give carrier 1A.

When the cross-sectional surface of the carrier 1A is observed by a scanning electron microscope, tin oxide is included in the coating layer in the form of aggregated particles. The thickness of the coating layer in the carrier 1A is 1.1 μm. Furthermore, an aggregation size is 560 nm and a primary particle size is 100 nm.

The carrier 1A has a carrier resistance of $3.2\times10^8$ Ωcm, a carrier resistance after storage under a high temperature and a high humidity of $5.0\times10^6$ Ωcm, and a carrier resistance after storage under a low temperature and a low humidity of $7.9\times10^8$ Ωcm.

Example 2A

Preparation of Carrier by Wet Process (Preparation of Core)

Ferrite particles (Mn—Mg ferrite, true specific gravity: 4.7 $g/cm^3$, volume average particle size: 35 μm, saturation magnetization: 60 emu/g) are prepared as a core for the carrier.

(Preparation of Solution for Forming Coating Layer 1)

- Cyclohexyl methacrylate copolymer lacquer (manufactured by Soken Chemical & Engineering Co., Ltd., weight average molecular weight: about 100,000)
- Tin oxide particles (trade name: PASSTRAN 4300, manufactured by Mitsui Mining & Smelting Co., Ltd., volume resistance: 8.9Ω·cm, particle size: 100 nm)

The above materials are mixed so that the tin oxide particles are included by 8 vol % in the formed coating layer. Glass beads are put into the mixture as a dispersion medium, and the mixture is stirred and dispersed for 60 minutes to prepare a solution for forming a coating layer 1.

(Formation of Coating Layer)

Next, the solution for forming a coating layer 1 and ferrite particles as a core are put into a vacuum deaerating kneader (trade name: KHO-5, manufactured by Inoue Manufacturing Co., Ltd.) so that the coating layer is formed by 3% by mass with respect to the above ferrite particles as a core, and stirred for 20 minutes. Thereafter the rotation number of the rotor is set to the lower limit value of 0.2 (20 rpm), the solvent is distilled off under a reduced pressure, and the residue is passed through a mesh having openings of 75 to prepare carrier 2A.

When the cross-sectional surface of the carrier 2A is observed by a scanning electron microscope, tin oxide is included in the coating layer in the form of aggregated particles. The thickness of the coating layer in the carrier 2A is 1.0 μm. Furthermore, an aggregation size is 470 nm and a primary particle size is 100 nm.

The carrier 2A has a carrier resistance of $5.0\times10^8$ Ωcm, a carrier resistance after storage under a high temperature and a high humidity of $1.6\times10^7$ Ωcm, and a carrier resistance after storage under a low temperature and a low humidity of $1.0\times10^9$ Ωcm.

Examples 1B to 1E

Carriers 1B to 1E are prepared in a similar manner to Example 1A, except that the conditions for pre-mixing in the planetary mixer are changed to that described in the following Table 1.

Example 1F

Carrier F is prepared in a similar manner to Example 1A, except that the tin oxide particles used in Example 1A is changed to PASSTRAN 6010 (trade name, manufactured by Mitsui Mining & Smelting Co., Ltd., particle size: 50 nm).

The aggregation size, primary particle size and the ratio thereof, and the particle size distribution of the obtained carriers 1A to 1F are shown in Table 1.

TABLE 1

| Carrier | Preparation conditions | Aggregation size (D) [nm] | Primary particle size (d) [nm] | Ratio (D/d) [nm] | Particle size distribution |
|---|---|---|---|---|---|
| 1A | 60 rpm, 1 hour | 560 | 100 | 5.6 | 3.2 |
| 1B | 60 rpm, 2 hours | 540 | 100 | 5.4 | 3.1 |
| 1C | 95 rpm, 1 hour | 535 | 100 | 5.4 | 2.8 |
| 1D | 95 rpm, 2 hours | 500 | 100 | 5.0 | 2.7 |
| 1E | 95 rpm, 3 hours | 490 | 100 | 4.9 | 2.4 |
| 1F | 60 rpm, 1 hour | 370 | 50 | 7.4 | 2.6 |

Examples 2B to 2E

Carriers 2B to 2E are prepared in a similar manner to Example 2A except that the rotation number of the rotor is changed to that described in the following Table 2.

Example 2F

Carrier 2F is prepared in a similar manner to Example 2A except that the tin oxide particles used in Example 2A is changed to PASSTRAN 6010 (trade name, manufactured by Mitsui Mining & Smelting Co., Ltd., particle size: 50 nm).

The aggregation size, primary particle size and the ratio thereof, and the particle size distribution of the obtained carriers 2A to 2F are shown in Table 2.

TABLE 2

| Carrier | Preparation condition (rotation number of rotor) | Aggregation size (D) [nm] | Primary particle size (d) [nm] | Ratio (D/d) [nm] | Particle size distribution |
|---|---|---|---|---|---|
| 2A | 0.2 | 470 | 100 | 4.7 | 3.3 |
| 2B | 0.3 | 420 | 100 | 4.2 | 2.9 |
| 2C | 0.4 | 395 | 100 | 4.0 | 2.7 |
| 2D | 0.5 | 380 | 100 | 3.8 | 2.5 |
| 2E | 0.6 | 370 | 100 | 3.7 | 2.4 |
| 2F | 0.2 | 320 | 50 | 6.4 | 2.6 |

Comparative Example 1

Carrier 3 is prepared in a similar manner to Example 1A except that pre-mixing by using a planetary is not performed.

Comparative Example 2

Carrier 4 is prepared in a similar manner to Example 2A except that the preparation is performed by setting the rotation number of the rotor to 0.8.

Comparative Example 3

Carrier 5 is prepared in a similar manner to Example 1A except that the preparation is performed so that carbon black (trade name: VULCAN 72, manufactured by Cabot Corporation, primary particle size: 20 nm) is included by 5 vol % instead of preparing so that the tin oxide particles are included by 8 vol % in the coating layer.

<Preparation of Developer>

12 parts of an external addition toner (volume average particle size: 5.5 μm) that is prepared by an emulsification-aggregation process and 100 parts of the carrier prepared as above are stirred by using a V blender at 40 rpm for 20 minutes, and the mixture is sieved by using a 125 μm mesh sieve to give a developer.

<Evaluation of Image Quality>

—Dullness of Image—

Using the above developer, 1% printing charts are printed on 100,000 sheets of paper for color copying (trade name: J PAPER, manufactured by Fuji Xerox Co., Ltd.) under an environment of 28° C. and 85% HR by using a copying machine (trade name: DOCU CENTRE COLOR 500, manufactured by Fuji Xerox Co., Ltd.) that has been modified. The dullness of the image on the 100,000$^{th}$ sheet is evaluated according to the following criteria.

G1: Color stain is clearly recognized by visual observation.

G2: Color stain is slightly recognized by visual observation.

G3: Color stain is not recognized at all.

—Fine Line Reproducibility—

[Conditions for Image Formation]

Toner image: line width: 10 μm

Amount of toner: 0.45 mg/cm$^2$

Recording paper: paper for color copying (trade name: J PAPER, manufactured by Fuji Xerox Co., Ltd.)

Rotation velocity of developer holder: 400 mm/sec 1-on 1-off images are output as 5 cm×5 cm charts in the vertical direction against the developing direction on the upper left, center and lower right of A4 paper by using the above modified machine at a resolution of 2,400 dpi. The grades of the 1$^{st}$, 500$^{th}$ and 1,000$^{th}$ output samples are evaluated using a graduated loupe of ×100 magnifications according to (10-L)×10 wherein L (μm) represents the distance at which the gap between lines is the narrowest due to spattering of the toner, and the like. In the evaluation of fine line reproducibility, the level at which no practical problem is caused is G70 or more.

The evaluation results are shown in Table 3.

TABLE 3

| | Inorganic oxide particles | | | | Carrier resistance (×10$^6$ Ωcm) | | | Image quality | |
|---|---|---|---|---|---|---|---|---|---|
| | Aggregation size (D) (nm) | Primary particle size (d) (nm) | Ratio (D/d) | Particle size distribution (GSD) | Before storage | After storage under high temperature and high humidity | After storage under low temperature and low humidity | Dullness | Fine line reproducibility |
| Example 1A | 560 | 100 | 5.6 | 3.2 | 320 | 5.0 | 794 | G2 | 80 |
| Example 1B | 540 | 100 | 5.4 | 3.1 | 250 | 6.3 | 501 | G2 | 85 |
| Example 1C | 535 | 100 | 5.4 | 2.8 | 250 | 6.3 | 500 | G3 | 85 |
| Example 1D | 500 | 100 | 5.0 | 2.7 | 200 | 6.3 | 630 | G3 | 85 |
| Example 1E | 490 | 100 | 4.9 | 2.4 | 500 | 5.0 | 1000 | G3 | 85 |
| Example 1F | 370 | 50 | 7.4 | 2.6 | 440 | 5.3 | 827 | G2 | 80 |
| Example 2A | 470 | 100 | 4.7 | 3.3 | 500 | 16 | 1000 | G3 | 90 |
| Example 2B | 420 | 100 | 4.2 | 2.9 | 630 | 16 | 1260 | G3 | 90 |
| Example 2C | 395 | 100 | 4.0 | 2.7 | 1260 | 20 | 2510 | G3 | 90 |
| Example 2D | 380 | 100 | 3.8 | 2.5 | 1000 | 16 | 1580 | G3 | 90 |
| Example 2E | 370 | 100 | 3.7 | 2.4 | 1000 | 13 | 1580 | G3 | 90 |
| Example 2F | 320 | 50 | 6.4 | 2.6 | 610 | 18 | 1380 | G3 | 90 |
| Comparative | 980 | 100 | 9.8 | 4.1 | 79 | 0.5 | 250 | G2 | 60 |

TABLE 3-continued

| | Inorganic oxide particles | | | | Carrier resistance ($\times 10^6$ Ωcm) | | | Image quality | |
|---|---|---|---|---|---|---|---|---|---|
| | Aggregation size (D) (nm) | Primary particle size (d) (nm) | Ratio (D/d) | Particle size distribution (GSD) | Before storage | After storage under high temperature and high humidity | After storage under low temperature and low humidity | Dullness | Fine line reproducibility |
| Example 1 | | | | | | | | | |
| Comparative Example 2 | 210 | 100 | 2.1 | 1.9 | 6300000 | 320000 | 10000000 | G1 | 80 |
| Comparative Example 3 | 70 | 20 | 3.5 | 1.8 | 400 | 35 | 820 | G1 | 90 |

It is found from Table 3 that Examples control decrease in carrier resistance, retain a certain carrier resistance or more even after storage, control variation in the resistance value due to the storage environment, decrease the dullness of the obtained image, and are excellent in fine line reproducibility, as compared to Comparative Examples. Comparative Example 2 has a too high carrier resistance value and is inferior to Examples in view of dullness of the image. Comparative Example 3 is inferior to Examples in view of dullness of the image.

Example 3A

Preparation of Carrier Including Inorganic Oxide Particles that are not Aggregated Carrier 3A is prepared in a similar manner to Example 2A, except that titanium oxide (trade name: JR, manufactured by Tayca, volume resistance: 5.2 Log Ω·cm, particle size: 270 nm) is used as a white electroconductive powder instead of tin oxide particles.

The carrier 3A has a carrier resistance of $5.0\times10^8$ Ωcm, a carrier resistance after storage under a high temperature and a high humidity of $3.2\times10^6$ Ωcm, and a carrier resistance after storage under a low temperature and a low humidity of $7.9\times10^8$ Ωcm.

Examples 3B to 3E, and Comparative Examples 4 and 5

Carriers 3B to 3E, and Comparative Examples 4 and 5 are prepared in a manner similar to Example 3A, except that titanium oxide particles having different particle sizes are used. Image quality is evaluated for the obtained carriers according to a process similar to that of Example 1A. The results are shown in Table 4.

TABLE 4

| | Inorganic oxide particles | | Carrier resistance ($\times 10^6$ Ωcm) | | | Image quality | |
|---|---|---|---|---|---|---|---|
| | Primary particle size (d) (nm) | Particle size distribution (GSD) | Before storage | After storage under high temperature and high humidity | After storage under low temperature and low humidity | Dullness | Fine line reproducibility |
| Example 3A | 270 | 2.1 | 500 | 3.2 | 790 | G3 | 75 |
| Example 3B | 350 | 2.3 | 400 | 4.0 | 1000 | G3 | 80 |
| Example 3C | 550 | 2.1 | 400 | 6.3 | 500 | G3 | 75 |
| Example 3D | 300 | 2.2 | 500 | 5.0 | 790 | G2 | 75 |
| Example 3E | 400 | 2.3 | 320 | 4.0 | 790 | G2 | 75 |
| Comparative Example 4 | 190 | 1.9 | 1600000 | 13000 | 3200000 | G1 | 75 |
| Comparative Example 5 | 1000 | 1.9 | 100 | 0.32 | 320 | G2 | 60 |

It is found from Table 4 that, decrease in carrier resistance is controlled, dullness in the obtained image is decreased, and fine line reproducibility is excellent in Examples in which the primary particles are within the range from 230 nm to 970 nm as compared to Comparative Example 5 even the inorganic oxide particles are not aggregated in the coating layer. Furthermore, Comparative Example 4 has a too high carrier resistance value, and is inferior to Examples in view of dullness of the image.

Examples 4A to 4C

Preparation of Carriers in which Resin is Changed

Carriers 4A to 4C are prepared in a similar manner to Example 1A, except that the following resins are used as the resin instead of the cyclohexyl methacrylate copolymer lacquer (manufactured by Soken Chemical & Engineering Co., Ltd., weight average molecular weight: about 100,000).

(Carrier 4A)

Styrene-methyl methacrylate copolymer lacquer (weight average molecular weight: about 130,000)

(Carrier 4B)

Styrene-methyl acrylate copolymer lacquer (weight average molecular weight: about 100,000)

(Carrier 4C)

Styrene-methyl methacrylate-acrylic acid copolymer lacquer (weight average molecular weight: about 160,000)

Image quality is evaluated for the obtained carriers according to a process similar to that of Example 1A. The results are shown in Table 5.

TABLE 5

| | | Inorganic oxide particles | | | | Carrier resistance Image quality ($\times 10^6$ Ωcm) | | | Image quality | |
|---|---|---|---|---|---|---|---|---|---|---|
| | Resin | Aggregation size (D) (nm) | Primary particle size (d) (nm) | Ratio (D/d) | Particle size distribution (GSD) | Before storage | After storage under high temperature and high humidity | After storage under low temperature and low humidity | Dullness | Fine line reproducibility |
| Example 1A | Cyclohexyl methacrylate | 560 | 100 | 5.6 | 3.2 | 320 | 5.0 | 794 | G2 | 80 |
| Example 4A | Styrene/ Methyl methacrylate | 540 | 100 | 5.4 | 3.1 | 340 | 5.5 | 870 | G2 | 70 |
| Example 4B | Styrene/ Methyl acrylate | 550 | 100 | 5.5 | 3.1 | 330 | 5.7 | 1050 | G2 | 70 |
| Example 4C | Styrene/ Methyl methacrylate/ Acrylic acid | 560 | 100 | 5.6 | 3.2 | 330 | 1.5 | 1200 | G2 | 60 |

It is found from Table 5 that decrease in carrier resistance is controlled more effectively in Example 1A that uses cyclohexyl methacrylate as the resin than in Examples 4A to 4C that use other resins.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A carrier for developing an electrostatic charge image, comprising:

a core; and a coating layer comprising a resin and inorganic oxide particles that exhibit electroconductivity, by which the core is coated, wherein the inorganic oxide particles have, when they are aggregated, an aggregation size of, or when they are not aggregated, a primary particle size of, from 230 nm to 970 nm, and the inorganic oxide particles in the coating layer have, when they are aggregated, a particle size distribution (GSD) of the aggregation size of, or when the particles are not aggregated, a particle size distribution (GSD) of the primary particle size of, 2.0 or more.

2. The carrier for developing an electrostatic charge image according to claim 1, wherein the inorganic oxide particles have an aggregation size of from 230 nm to 970 nm, and a ratio of the aggregation size to the primary particle size of the inorganic oxide is from 2.8 to 7.5.

3. The carrier for developing an electrostatic charge image according to claim 1, wherein a content of the inorganic oxide particles is from 0.2% by mass to 10% by mass with respect to the carrier.

4. The carrier for developing an electrostatic charge image according to claim 1, wherein the inorganic oxide particles include tin oxide.

5. The carrier for developing an electrostatic charge image according to claim 1, wherein the resin includes a polymer including repeating units derived from a methacrylic acid ester having an alicyclic group.

6. The carrier for developing an electrostatic charge image according to claim 5, wherein a weight average molecular weight of the polymer including repeating units derived from the methacrylic acid ester having an alicyclic group is from $4.0\times10^4$ to $3.0\times10^5$.

7. The carrier for developing an electrostatic charge image according to claim 5, wherein the methacrylic acid ester having an alicyclic group comprises cyclohexyl methacrylate.

8. The carrier for developing an electrostatic charge image according to claim 5, wherein a thickness of the coating layer is from 0.3 μm to 10 μm.

9. The carrier for developing an electrostatic charge image according to claim 1, wherein the core includes magnetic particles.

10. The carrier for developing an electrostatic charge image according to claim 9, wherein the magnetic particles include ferrite.

11. The carrier for developing an electrostatic charge image according to claim 9, wherein a particle size of the magnetic particles is from 0.01 μm to 1 μm.

12. The carrier for developing an electrostatic charge image according to claim 1, wherein a magnetic force of the carrier at 1 kOe is from 170 emu/cm$^3$ to 250 emu/cm$^3$.

13. The carrier for developing an electrostatic charge image according to claim 1, wherein a sphericity of the carrier is from 0.980 to 1.000.

14. The carrier for developing an electrostatic charge image according to claim 1, wherein a volume resistivity of the carrier is from $1\times10^7$ Ωcm to $1\times10^{14}$ Ωcm.

15. A developer for an electrostatic charge image, comprising a toner and the carrier for developing an electrostatic charge image according to claim 1.

16. A process cartridge comprising a developing device, wherein the developer for an electrostatic charge image according to claim 15 is housed in the developing device.

* * * * *